US006605585B1

(12) United States Patent
Durbut et al.

(10) Patent No.: US 6,605,585 B1
(45) Date of Patent: Aug. 12, 2003

(54) LIQUID CLEANING COMPOSITIONS

(75) Inventors: Patrick Durbut, Verviers (BE); Guy Broze, Grace-Hollogne (BE); Francoise Mathieu, Embourg (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/365,661

(22) Filed: Feb. 13, 2003

Related U.S. Application Data

(63) Continuation-in-part of application No. 10/236,160, filed on Sep. 6, 2002, now Pat. No. 6,534,468.

(51) Int. Cl.[7] ..... C11D 17/00

(52) U.S. Cl. ..... 510/417; 510/422; 510/426; 510/427; 510/432; 510/492; 510/506; 510/508; 510/480; 510/512

(58) Field of Search ..... 510/417, 426, 510/422, 432, 492, 506, 508, 512, 480

(56) References Cited

U.S. PATENT DOCUMENTS 5,866,532 A * 2/1999 Jackson et al. ..... 510/466
5,994,283 A * 11/1999 Durbut et al. ..... 510/242
6,197,732 B1 * 3/2001 Davister et al. ..... 510/122

* cited by examiner

*Primary Examiner*—Necholus Ogden
(74) *Attorney, Agent, or Firm*—Richard E. Nanfeldt

(57) ABSTRACT

All purpose cleaning or microemulsion compositions more environmentally friendly, which is especially effective in the removal of oily or greasy soils contains a positively charged surfactant-polymer complex, a hydrocarbon ingredient, a cosurfactant, and water.

1 Claim, No Drawings

LIQUID CLEANING COMPOSITIONS

RELATED APPLICATION

This application is a continuation in part application of U.S. Ser. No. 10/236,160 filed Sep. 6, 2002 now U.S. Pat. No. 6,534,468.

FIELD OF THE INVENTION

The present invention relates to a hard surface cleaning composition containing a positively charged complex.

BACKGROUND OF THE INVENTION

This invention relates to an improved all-purpose liquid cleaner designed in particular for cleaning hard surfaces including toilet bowls and which is effective in removing grease soil and/or bath soil and in leaving unrinsed surfaces with a shiny appearance.

In recent years all-purpose liquid detergents have become widely accepted for cleaning hard surfaces, e.g., painted woodwork and panels, tiled walls, wash bowls, bathtubs, linoleum or tile floors, washable wall paper, etc.. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. No. 4,472,291—Rosario; U.S. Pat. No. 4,540,448—Gauteer et al; U.S. Pat. No. 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; U.S. Pat. Nos. 4,414,128; and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) being in the range of 5:1 to 1:3; and (c ) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; non-aqueous solvent, e.g., alcohols and glycol ethers, up to 10% by weight; and hydrotropes, e.g., urea, ethanolamines, salts of lower alkylaryl sulfonates, up to 10% by weight. All of the formulations shown in the Examples of this patent include relatively large amounts of detergent builder salts which are detrimental to surface shine.

A pH neutral microemulsion composition based on paraffin sulfonate and ethoxylated nonionic surfactant is able to deliver improved grease cleaning versus built, alkaline compositions. Besides the improved grease cleaning, this approach is much safer to surfaces as well as less aggressive on consumer's hands (Loth et al—U.S. Pat. No. 5,075,026).

The microemulsion technology provides outstanding oil uptake capacity because of the adjustment of the curvature of the surfactant micelles by the molecules of the cosurfactant. Rod-like micelles are preferred as they can "swallow" oil to become globular without increasing the surface of contact between the hydrophobic core of the micelle and the hydrophilic continuous phase.

In diluted usage however, the microemulsion state is usually lost and the cleaning performance relies on the adsorption efficacy and leaving character of the surfactant system. Nonionic surfactants perform very well on grease, as they are excellent grease "solubilizers". Actually, they spontaneously form swollen micelles. In moderate climate countries such as the northern states of the United States and the northern countries of Europe, the soil on the hard surfaces contains a major proportion of greasy materials. It is accordingly not surprising that the anionic-nonionic surfactant based microemulsion is very efficient in those countries. However, nonionic surfactants do not impart oil repelling properties and can not deliver soil antiattachment properties on treated hard surfaces so as to achieve next time easier cleaning of said treated surface.

The instant invention teaches hard surface cleaning containing a positively charged complex of an anionic surfactant which is an alkali metal salt of a nonfluorinated anionic surfactant or an ammonium salt of a nonfluorinated anionic surfactant, or a mixture thereof, which exhibits very low surface tensions, with a polycationic polymer that imparts oil repelling properties and delivers soil antiattachment properties on treated hard surfaces and delivers this desired property.

SUMMARY OF THE INVENTION

The present invention provides an improved, clear, liquid hard surface cleaning composition having improved interfacial tension which improves cleaning hard surfaces such as plastic, vitreous and metal surfaces having a shiny finish, oil stained floors, automative engines and other engines. More particularly, the improved cleaning compositions exhibit good grease soil removal properties and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant compositions exhibit a grease release effect in that the instant compositions impede or decrease the anchoring of greasy soil on surfaces that have been cleaned with the instant compositions as compared to surfaces cleaned with a microemulsion composition which means that the grease soiled surface is easier to clean upon subsequent cleanings.

Surprisingly, these desirable results are accomplished even in the absence of polyphosphate or other inorganic or organic detergent builder salts and also in the complete absence or substantially complete absence of grease-removal solvent.

The invention generally provides a stable, clear all-purpose, hard surface cleaning composition especially effective in the removal of oily and greasy oil. The cleaning composition includes, on a weight basis:

about 0.1% to about 20%, more preferably about 0.2% to about 15% of a positively charged complex comprising at least one alkali metal salt of a nonfluorinated anionic surfactant or an ammonium salt of a nonfluorinated anionic surfactant, or a mixture thereof and a polycationic polymer;

about 0 to about 25%, more preferably 1% to 20%, of a water-mixable cosurfactant having either limited ability or substantially no ability to dissolve oily or greasy soil; and the balance being water, said proportions being based upon the total weight of the composition.

The cleaning composition can be in the form of a microemulsion in which case the concentration of the water mixable cosurfactant is about 0 to about 25 wt. %, preferably about 1 wt. % to about 20 wt. % and the concentration of a perfume or water insoluble hydrocarbon is about 0.4 wt. % to about 5.0 wt. %. The dispersed oil phase of the o/w microemulsion is composed essentially of a water-immiscible or hardly water-soluble perfume.

The present invention relates to a stable all purpose hard surface cleaning or microemulsion composition containing a surfactant-polymer complex for delivering soil antiattachment properties. The invention also relates to a light duty liquid composition or light duty liquid microemulsion composition. This present invention also useful in the formation of toilet bowl cleaners.

DETAILED DESCRIPTION OF THE INVENTION

The present invention relates to a stable hard surface cleaning composition approximately by weight: 0.1% to 20% of a positively charged complex of an alkali metal salt of a nonfluorinated anionic surfactant or an ammonium salt of a nonfluorinated anionic surfactant, or a mixture thereof and a polycationic polymer, 0 to 25% of a cosurfactant, and the balance being water, wherein the cleaning composition can be in the form of a microemulsion in which case the concentration of the water mixable cosurfactant is about 0 to about 25.0 wt. %, preferably about 0.1 wt. % to about 25.0 wt. % and the concentration of a perfume or water insoluble hydrocarbon is about 0.4 wt. % to about 5.0 wt. %.

When mixing an alkali metal salt such as sodium of a nonfluorinated anionic surfactant or an ammonium salt of a nonfluorinated anionic surfactant, or a mixture thereof and a polycationic polymer, attractive interactions are developed that are very strong and lead to the formation of anionic-cationic complexes in-situ. The complex interactions take place along the polymer backbone, so that surfactant-polymer complexes exist in solution. Attention must be paid not to complex all the positive charges on the polycationic polymer so as to still have enough electric charges on the whole structure so that the complex is positively charged so as to keep the complex water soluble (otherwise phase separation or precipitation might occur). The presence of positive charges on the surfactant-polymer system allows subsequent anchorage on substrate surface for modifying the surface energy.

One of the objects of the instant invention is to deliver higher proportions of anionic surfactant in the adsorbed layer at the solid-water interface. This is due to a boosted adsorption tendency by means of neutralization between the negative charge of the anionic surfactant and the positive charge of the polycationic polymer that is used in admixture with the anionic surfactant in the instant compositions and due to an increased hydrophobic character imparted to the polymer by the anionic surfactant linked to its backbone. Two anionic surfactants can be used in composition wherein one of the anionic surfactants will possibly preferentially associate with the polycationic polymer through electrostatic interactions.

According to the present invention, the role of the hydrocarbon is provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear (as a consequence of the formation of a microemulsion) and highly fragranced (as a consequence of the perfume level).

Second, the need for use of solubilizers, which do not contribute to cleaning performance, is eliminated.

Third, an improved grease release effect and an improved grease removal capacity in neat (undiluted) usage of the composition or after dilution of the composition can be obtained without detergent builders or buffers or conventional grease removal solvents at neutral or acidic pH and at low levels of active ingredients while improved cleaning performance can also be achieved in diluted usage.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight. The essential oils themselves are volatile odoriferous compounds and also serve to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the hard surface cleaning composition in an amount of from 0 to 5% by weight, preferably 0.4% to 5% by weight, more preferably from 0.4% to 3.0% by weight, especially preferably from 0.5% to 2.0% by weight. If the hydrocarbon (perfume) is added in amounts more than 5% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

Thus, merely as a practical matter, based on economic consideration, the microemulsion compositions of the present invention may often include as much as 0.2% to 7% by weight, based on the total composition, of terpene solvents introduced thereunto via the perfume component. However, even when the amount of terpene solvent in the cleaning formulation is less than 1.5% by weight, such as up to 0.6% by weight or 0.4% by weight or less, satisfactory grease removal and oil removal capacity is provided by the inventive diluted microemulsions.

In place of the perfume one can employ a water insoluble paraffin or isoparaffin having 6 to 18 carbon at a concentration of 0 to 5 wt. percent, preferably 0.4 to 5.0 wt. percent, more preferably 0.4 to 3.0 wt. %.

The positively charged complex contained in the instant compositions comprises a complex of:

(a) an alkali metal salt such as sodium of a nonfluorinated anionic surfactant or an ammonium salt of a nonfluorinated anionic surfactant, or a mixture thereof; and (b) a polycationic polymer, wherein the molar ratio of the anionic surfactant to the positively charged binding sites available on the polycationic polymer backbone is 0.95:1 to 0.05:1, more preferably 0.9:1 to 0.1:1. The instant composition contains about 0.1 to about 20 wt. %, more preferably about 0.2 to about 15 wt. % of the positively charged complex.

Suitable water-soluble non-soap, anionic surfactants which are nonfluorinated which are used in the instant compositions include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an α-olefin.

Other examples of suitable anionic sulfonate surfactants are the paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735, 096.

Examples of satisfactory anionic sulfate surfactants are the $C_8$–$C_{18}$ alkyl sulfate salts the ethoxylated $C_8$–$C_{18}$ alkyl ether sulfate salts having the formula $R(OC_2H_4)_nOSO_3M$ wherein n is 1 to 12, preferably 1 to 5, and M is a metal cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

On the other hand, the ethoxylated alkyl ether sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. The ethoxylated alkyl ether sulfates differ from one another in the number of moles of ethylene oxide reacted with one mole of alkanol. Preferred alkyl sulfates and preferred ethoxylated alkyl ether sulfates contain 10 to 16 carbon atoms in the alkyl group.

The ethoxylated $C_8$–$C_{12}$ alkylphenyl ether sulfates containing from 2 to 6 moles of ethylene oxide in the molecule also are suitable for use in the inventive compositions. These surfactants can be prepared by reacting an alkyl phenol with 2 to 6 moles of ethylene oxide and sulfating and neutralizing the resultant ethoxylated alkylphenol.

Other suitable anionic surfactants are the $C_9$–$C_{15}$ alkyl ether polyethenoxyl carboxylates having the structural formula $R(OC_2H_4)_nOX$ COOH wherein n is a number from 4 to 12, preferably 5 to 10 and X is selected from the group consisting of $CH_2$, $(C(O)R_1$ and

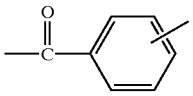

wherein $R_1$ is a $C_1$–$C_3$ alkylene group. Preferred compounds include $C_9$–$C_{11}$ alkyl ether polyethenoxy (7–9) C(O) $CH_2CH_2COOH$, $C_{13}$–$C_{15}$ alkyl ether polyethenoxy (7–9)

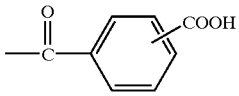

and $C_{10}$–$C_{12}$ alkyl ether polyethenoxy (5–7) CH2COOH. These compounds may be prepared by condensing ethylene oxide with appropriate alkanol and reacting this reaction product with chloracetic acid to make the ether carboxylic acids as shown in U.S. Pat. No. 3,741,911 or with succinic anhydride or phthalic anhydride. Obviously, these anionic surfactants will be present either in acid form or salt form depending upon the pH of the final composition, with salt forming cation being the same as for the other anionic surfactants.

The polycationic polymer is a polyacrylamide dialkyl dimethyl ammonium chloride copolymer having about 25 wt. % to 90 wt. % of the dialkyl dimethyl ammonium chloride monomer and is depicted by the structure of:

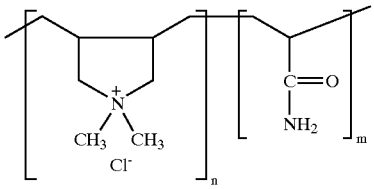

wherein m is about 5000 to about 60000.

Another useful polycationic polymer is a polyvinyl pyrrolidone/vinyl imidazole/quaternized vinyl-imidazole [40/40/20] terpolymer. The ratio of comonomers in the foregoing terpolymer is not particularly critical and can be modified to provide the desired soil antiattachment effect.

A cosurfactant can be optionally used in forming the microemulsion composition. A major class of compounds have been found to provide highly suitable cosurfactants over temperature ranges extending from 5° C. to 43° C., for instance, water-soluble $C_3$–$C_4$ alkanols, polyethylene glycols of the formula $HO(CH_2CH_2O)nH$ wherein n is about 8 to about 14, polypropylene glycol of the formula $HO(CH_3CHCH_2O)_nH$ wherein n is a number from 2 to 18 and copolymers of ethylene oxide and propylene oxide and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_2(CH_3)CH)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), propylene glycol monomethyl ether, dipropylene glycol monomethyl ether, triethylene glycol monobutyl ether, mono, di, tri propylene glycol monobutyl ether, tetraethylene glycol monobutyl ether, triethylene glycol monohexyl ether, tetraethylene glycol monohexyl ether, pentaethylene glycol monohexyl ether, propylene glycol tertiary butyl ether, ethylene glycol monoacetate and dipropylene glycol propionate.

The amount of cosurfactant which might be required to stabilize the microemulsion compositions will, of course, depend on such factors as the surface tension characteristics of the cosurfactant, the type and amounts of the complex and perfumes, and the type and amounts of any other additional ingredients which may be present in the composition and which have an influence on the thermodynamic factors enumerated above. Generally, amounts of cosurfactant in the range of from 0 to 25 wt. %, preferably from 0.5 wt. % to 20 wt. %, especially preferably from 1 wt. % to 10 wt. %, provide stable microemulsions for the above-described levels of primary surfactants and perfume and any other additional ingredients as described below.

The ability to formulate neutral or acidic products without builders which have grease removal capacities is a feature of the present invention because the prior art o/w microemulsion formulations most usually are highly alkaline or highly built or both.

The final essential ingredient in the inventive hard surface cleaning compositions having improved interfacial tension properties is water. The proportion of water in the microemulsion compositions generally is in the range of 60 wt. % to 97 wt. %, preferably 80 wt. % to 97 wt. % of the usual diluted o/w microemulsion composition.

An optional ingredient for use herein is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system, the nature of the surfactant-polymer complex and cosurfactant, as well as the availability and cost factors, other suitable polyvalent metal ions include aluminum, copper, nickel, iron, calcium, etc. It should be noted, for example, that with the preferred nonfluorinated anionic detergent calcium salts will precipitate and should not be used. It has also been found that the aluminum salts work best at pH below 5. As the salt, the same general classes of anions as mentioned for the magnesium salts can be used, such as halide (e.g., bromide, chloride), sulfate, nitrate, hydroxide, oxide, etc.

The proportion of the multivalent salt generally will be selected so that at the appropriate weight ratio between the anionic surfactant and the polycationic polymer to deliver desired performance from the surfactant-polymer mixture in terms of adsorption properties on hard surfaces and soil antiattachment on treated hard surfaces, the physical stability of the total composition is kept, that can be impaired due to an increased hydrophobicity of the anionic surfactant in the presence of multivalent salt instead of alkali metal cation such as the sodium salt thereof. As a consequence, the proportion of the multivalent salt will be selected so that the added quantity will neutralize from 0.1 to 1.5 equivalents of the anionic surfactant, preferably 0.9 to 1.4 equivalents of the acid form of the anionic surfactant. At higher concentrations of anionic surfactant, the amount of multivalent salt will be in range of 0.5 to 1 equivalents per equivalent of anionic surfactant.

The all-purpose liquid cleaning or microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

The instant compositions can contain 0 to 4 wt. %, more preferably 0.05 to 3 wt. % of an inorganic acid such as hydrochloric, sulfuric or phosphoric acid and an organic acid such as an alpha hydroxy aliphatic acid, a mono or dicarboxylic acid having 4 to 10 carbon atoms and mixtures thereof.

In final form, the all-purpose cleaning or clear microemulsions exhibit stability at reduced and increased temperatures. More specifically, such compositions remain clear and stable in the range of 4° C. to 50° C., especially 10° C. to 43° C. Such compositions exhibit a pH in the acidic to neutral range depending on intended end use. The liquids are readily pourable and exhibit a viscosity in the range of 6 to 60 milliPascal.Second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the all purpose cleaning or microemulsion compositions, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

EXAMPLE 1

The following compositions A to C in wt. % were prepared by simple mixing of the ingredients in water, using the following materials:

Merquat 550, ex. Nalco: Poly[acrylamide-diallyldimethyl ammonium chloride] copolymer. Average MW 4.5–5.0 $10^6$. About 50/50 wt. % ratio.

| | A | B | C | Reference |
|---|---|---|---|---|
| Paraffin sulfonate, Na salt | — | 0.07 | 0.14 | — |
| Merquat 550 | 0.5 | 0.5 | 0.5 | — |
| Water | Bal. | Bal. | Bal. | Bal. |
| Grease Release Performance:[a] Nbr. of Gardner strokes | 30 | 28 | 26 | 27 |
| Percentage soil removal[b] (Reflectance data) | 5 | 89 | 76 | 4 |

(a) Grease release performance pair comparison tests have been conducted using compositions A–C from Example 3. 15×15 cm formica tiles are pretreated by spreading 2 ml of composition A–C on half part of each tiles in horizontal position and allowed to rest for 90s. The other half part remains untreated and is taken as reference in the test. After 90 seconds excess solution was drained off by tipping the tiles 90 degrees. The tiles are dried overnight at room temperature. A $CHCl_3$ solution of hardened grease is sprayed on the whole surface of pre-treated sample tiles. A standard cleaner composition is used for cleaning the soiled tiles according to grease release test procedure. The cleaning process is performed using a Gardner Washability Machine (Gardner Laboratory, Maryland).

(b) The way to discriminate between different tile treatments is by determining the amount of soil removed from tiles through reflectance measurements before soiling, after soiling, and after a defined number of Gardner strokes. The soil removal percentage value given as reference in Example 3 is indicative and corresponds to the cleaning performance of standard cleaning composition on the untreated half part of sample tiles.

What is claimed:

1. A hard surface microemulsion cleaning composition comprising:

(a) about 0.1 wt. % to about 20 wt. % of a positively charged complex comprising:

(i) an alkali metal salt or an ammonium salt of an anionic surfactant or a mixture thereof which is not fluorinated; and (ii) a polycationic polymer being complexed with said anionic surfactant in a molar ratio of said anionic surfactant to the positively charged binding sites available on the backbone of said polycationic polymer of about 0.95:1 to 0.05:1;

(b) about 0 to about 25 wt. % of a glycol ether selected from the group consisting of glycol monobutyl ether, diethylene glycol monobutyl ether, pentaethylene glycol monohexyl ether and mixtures thereof;

(c) about 0 to about 5 wt. % of a water insoluble hydrocarbon or a perfume; and

60–97% by weight of water.

* * * * *